United States Patent [19]

Ishigaki et al.

[11] Patent Number: 4,770,702

[45] Date of Patent: Sep. 13, 1988

[54] PROCESS FOR PRODUCING THE RARE EARTH ALLOY POWDERS

[75] Inventors: Naoyuki Ishigaki, Otsu; Takaki Hamada, Takatsuki; Setsuo Fujimura, Kyoto, all of Japan

[73] Assignee: Sumitomo Special Metals Co., Ltd., Osaka, Japan

[21] Appl. No.: 145,981

[22] Filed: Jan. 20, 1988

Related U.S. Application Data

[62] Division of Ser. No. 801,321, Nov. 25, 1985.

[30] Foreign Application Priority Data

| | | | |
|---|---|---|---|
| Nov. 27, 1984 | [JP] | Japan | 59-248797 |
| Nov. 27, 1984 | [JP] | Japan | 59-248798 |
| Dec. 10, 1984 | [JP] | Japan | 59-260479 |
| Dec. 10, 1984 | [JP] | Japan | 59-260480 |

[51] Int. Cl.[4] ..... C22C 29/14

[52] U.S. Cl. ..... 75/244; 75/246; 75/251; 420/83; 420/121; 420/590; 419/32; 419/34; 419/36

[58] Field of Search ..... 420/83, 121, 590; 75/246, 244, 251; 419/32, 34, 36

[56] References Cited

U.S. PATENT DOCUMENTS

| | | | |
|---|---|---|---|
| 4,597,938 | 7/1986 | Matsuura et al. | 419/23 |
| 4,601,875 | 7/1986 | Yamamoto et al. | 419/23 |
| 4,663,066 | 5/1987 | Fruchart et al. | 420/83 |
| 4,684,406 | 8/1987 | Matsuura et al. | 75/244 |

*Primary Examiner*—Stephen J. Lechert, Jr.
*Attorney, Agent, or Firm*—Wegner & Bretschneider

[57] ABSTRACT

A rare earth-iron-boron alloy powder which consists essentially of:

12.5 to 20 at % R wherein $R_1$ is 0.05 to 5 at %, 4 to 20 at % B, and 60 to 83.5 at % Fe, wherein $R_1$ is at least one heavy rare earth element selected from the group consisting of Gd, Tb, Dy, Ho, Er, Tm and Yb, 80 to 100 at % of $R_2$ consists of Nd and/or Pr, the balance in the $R_2$ being at least one element selected from the group consisting of rare earth elements including Y and except for $R_1$, and $R=R_1=R_2$ by atomic %, wherein a major phase of at least 80 vol % of the entire alloy coinsists of a tetragonal structure, and wherein oxygen does not exceed 10,000 ppm, carbon does not exceed 1000 ppm and calcium does not exceed 2000 ppm. The alloy powder is produced by directly reducing a mixture comprising rare earth oxide, iron and other ingredients or oxide thereof with a reducing agent Ca and $CaCl_2$, putting the reduced product into water, then treating with water. Up to 35 at % Co may be substituted for Fe.

14 Claims, No Drawings

PROCESS FOR PRODUCING THE RARE EARTH ALLOY POWDERS

This application is a divisional of Ser. No. 801,321, filed Nov. 25, 1985.

FIELD OF THE INVENTION

The present invention relates to a rare earth alloy powder used for the production of FeBR base high-performance rare earth magnets, and a process for producing such a powder. In the present disclosure, a symbol R represents lanthanide and Y, and the term "rare earth" or "rare earth element(s)" represents the same.

BACKGROUND OF THE INVENTION

Particular attention has been paid to the FeBR base magnets as novel high-performance permanent magnets using rare earth elements (R) represented by Nd, Pr and the like. As already disclosed in Japanese Patent Kokai-Publication No. 59-46008 filed by the present applicant company, the FeBR base magnets have properties comparable to those of the prior art high-performance magnets SmCO, and are advantageous in that scarece and expensive Sm is not necessarily used as the essential ingredient. In particular, since Nd has been considered to be a component of substantially useless, it is very advantageous that Nd can be used as the main component.

However, since the FeBR magnet alloys have a relatively low Curie temperature that is around 300° C., there is a fear that their stability at temperatures higher than room temperature may be insufficient. It has been proposed to improve the stability of the FeBR magnet alloys with respect to temperature by substituting Co for a part of Fe to form FeCoBR magnet alloys (see Japanese Patent Kokai-Publication No. 59-64733).

SUMMARY OF THE DISCLOSURE

Furthermore, in order to improve the R-Fe-B and R-Fe-Co-B base magnets, the present applicant company has already developed $R_1$-$R_2$-Fe-B and $R_1$-$R_2$-Fe-Co-B base rare earth magnets, wherein $R_1$ is at least one heavy rare earth element selected from the group consisting of Gd, Tb, Dy, Ho, Er, Tm adn Yb, and at least 80 at % of $R_2$ consists of Nd and/or Pr, while the balance being at least one element from the group consisting of rare earth elements including Y and except for $R_1$ by substituting at least one heavy rare earth element selected from the group consisting of Gd, Tb, Dy, Ho, Er, Tm and Yb of 5 at % or lower (relative to the entire alloy) for light rare earth elements such as Nd and/or Pr, said magnets having a high maximum energy product (BH)max of 20 MGOe or higher and a coercive force iHc considerably increased to 10 kOe or higher, and being capable of being used in a temperature environment of 100° to 150° C. (Japanese Patent Application Nos. 58-140590 and 58-141850, now published under EP-Publication Nos. 0134305 and 0134304.

The starting materials used for the production of the $R_1$-$R_2$-Fe-B and $R_1$-$R_2$-Fe-Co-B base rare earth magnets are expensive bulk or lump metals containing small amounts of impurities such as, for instance, rare earth metals of at least 99.5% purity which are prepared by the electrolysis or thermal reduction technique, electroytic iron or boron of at least 99.5% purity. These raw materials are all high-quality materials which are previously obtained from ores by purification and contain reduced amounts of impurities, and so the magnet products made thereof become expensive. In particular, the price of rare earth metal materials is very high, since the production thereof needs highly developed separation and purification techniques, and is only carried out with unsatisfactory efficiency.

Thus, the $R_1$-$R_2$-Fe-B and $R_1$-$R_2$-Fe-Co-B base permanent magnets will be brought to market at considerably high prices, although they possess high-performance, as indicated by their iHc, and are very useful as practical permanent magnet materials.

An object of the present invention is to solve or eliminate the aforesaid problems and to provide on an industrial mass-production scale rare earth-containing R($R_1$-$R_2$)-Fe-B and R($R_1$-$R_2$)-Fe-Co-B base alloy powders for magnet materials which are inexpensive and have an improved quality. Unless otherwise noted in the present disclosure, $R_1$ stands for at least one element selected from the group consisting of Gd, Tb, Dy, Ho, Er, Tm and Yb, and at least 80 at % of $R_2$ consists of Nd and/or Pr, while the balance of $R_2$ being at least one element selected from the group consisting of rare earth elements including Y and except for $R_1$.

According to the first aspect of the present invention, there is provided a rare earth-containing alloy powder consisting essentially of:

12.5 to 20 at % R wherein $R_1$ is 0.05 to 5 at %, 4 to 20 at % B, and 60 to 83.5 at % Fe, wherein $R_1$ is at least one heavy rare earth element selected from the group consisting of Gd, Tb, Dy, Ho, Er, Tm and Yb, 80 to 100 at % of $R_2$ consists of Nd and/or Pr, the balance in $R_2$ being at least one element selected from the group consisting of rare earth elements including Y and except for $R_1$, and $R=R_1+R_2$ (by atomic %)—referred to as "the first aspect composition"—, wherein a major phase of at least 80 vol % of the entire alloy consists of a tetragonal structure, and wherein oxygen does not exceed 10,000 ppm, carbon does not exceed 1000 ppm and calcium does not exceed 2000 ppm.

According to the second aspect of the present invention, there is provided a process for the production of rare earth-containing alloy powders having a composition to be described just below, an oxygen content not exceeding 10,000 ppm, a carbon content not exceeding 1000 ppm and a calcium content not exceeding 2000 rpm, characterized by comprising the steps of:

providing a starting mixed powdery material by formulating at least one oxide of rare earth elements selected from the group consisting of the aforesaid rare earth elements, in iron powder and at least one powder selected from the group consisting of a boron powder, a ferroboron powder and a boron oxide powder, or alloy powders or mixed oxides of said componential elements in such a manner that the resulting alloy has a composition wherein the same composition as the first aspect composition forms an essential main component;

mixing said starting powdery material with metallic calcium in an amount of 1.2 to 3.5 times (by weight ratio) as of the stoichiometric amount required for reduction with respect to the amount of oxygen contained in the starting powdery material such as said rare earth oxides, and with calcium chloride in an amount of 1 to 15% by weight of said rare earth oxides;

reducing and diffusing the resulting mixture body at a temperature of 950° to 1200° C. in an inert atmosphere;

putting the resultant reaction product into water to provide a slurried state; and treating the resultant slurry with water to obtain a rare earth-containing alloy powder having a major phase of (at least 80 vol % of of the entire alloy) of a tetragonal structure. It is preferred to put said reaction product into water after crushing it to a specific size. It is preferred to compact said resulting mixture before the reducing to promote the reaction. However, the compacting may be omitted.

According to the third aspect of the present invention, there is provided a rare earth-containing alloy powder consisting essentially of:

12.5 to 20 at % R wherein $R_1$ is 0.05 to 5 at %, 4 to 20 at % B, 45 to 82 at % Fe, and up to 35 at % Co, wherein $R_1$ and $R_2$ have the same meaning as defined in the first aspect, and $R=R_1+R_2$, characterized in that a major phase of at least 80 vol % of the entire alloy consists of a tetragonal structure, an oxygen content not exceeding 10,000 ppm, a carbon content not exceeding 1000 ppm and a calcium content not exceeding 2000 ppm. Here, Fe is preferably 45 to 80 at %.

According to the fourth aspect of the present invention, there is provided a process for the production of rare earth-containing alloy powders having a composition to be described just below, an oxygen content not exceeding 10,000 ppm, a carbon content not exceeding 1000 ppm and a calcium content not exceeding 2000 ppm, characterized by comprising the steps of:

providing a starting mixed powdery material by formulating at least one rare oxide selected from the group consisting of the aforesaid rare earth oxides, an iron powder, a cobalt powder and at least one powder selected from the group consisting of a (pure) boron powder, a ferroboron powder and a boron oxide powder, or alloy powders or mixed oxides of said componental elements in such a manner that the resulting alloy having a composition consisting essentially of:

12.5 to 20 at % R wherein $R_1$ is 0.05 to 5 at %, 4 to 20 at % B, 0 (exclusive) to 35 (inclusive) at % Co, and 40 to 82 at % Fe, wherein $R_1$ and $R_2$ have the same meanings as defined in the first aspect, and $R=R_1+R_2$;

mixing said starting powdery material with metallic calcium in an amount of 1.2 to 3.5 times (by weight ratio) of as the stoichiometric amount required for reduction with respect to the amount of oxygen contained in the starting powdery material such as said rare earth oxides, and with calcium chloride in an amount of 1 to 15% by weight of said rare earth oxides;

reducing and diffusing the resulting mixture at a temperature of 950° to 1200° C. in an inert atmosphere;

putting the resultant reaction product into water to provide a slurried state; and treating the resultant slurry with water to obtain a rare earth-containing alloy powder having a major phase (i.e., at least 80 vol % of the entire alloy phase) of a tetragonal structure. It is preferred to put the reaction product into water after crushing to a desired size. It is preferred to compact said resulting mixture before the reducing to promote the reaction. However, the compacting may be omitted. Here, Fe of 45 at % or more is preferred.

In the 2nd and 4th aspects, the amount of the rare earth oxides is defined by considering the yield at the reducing reaction based on the amount of the rare earth metal in the resultant alloys, e.g., the former is about 1.1 times of the latter. In the 2nd and 4th aspects the reducing temperature is preferably 950° to 1100° C.

In all the aspects, the oxygen amount not exceeding 6000 ppm in the resultant alloy powder is preferred.

By using the $R_1$-$R_2$-Fe-B and $R_1$-$R_2$-Fe-Co-B base alloy powders of the present invention, it is possible to provide at low costs $R_1$-$R_2$-Fe-B and $R_1$-$R_2$-Fe-Co-B base rare earth magnets which can be used at temperatures of not lower than room temperature in a sufficiently stable state, while they maintain magnet properties represented in terms of (BH)max of at least 20 MGOe and iHc of at least 10 kOe.

From the starting materials such as, for instance, inexpensive light rare earth oxides, e.g., $Nd_2O_3$ or $Pr_6O_{11}$, and inexpensive heavy rare earth oxides, e.g., $Tb_3O_4$, which are the intermediate materials used in the pre-stage for the production of rare earth metals; Fe powders; cobalt powders; and pure boron powders (whether crystalline or amorphous) as well as Fe-B powders or boron oxides such as $B_2O_3$, the alloy powders of the present invention are produced by the step using metallic calcium as the reducing agent and calcium chloride ($CaCl_2$) so as to faciliate disintegration of the reduction reaction product. Thus, it is possible to easily obtain on an industrial mass-production scale the alloy powders for $R_1$-$R_2$-Fe-B and $R_1$-$R_2$-Fe-Co-B magnets, which are of high quality and can be produced at a lower cost, as compared with the use of various bulk or lump metals. Other additional elements M (described lateron) may be added to the alloy powders of the present invention. For this purpose, metal powders, oxides (including mixed oxides with the componental elements), alloy powders (including alloys with the componental elements) or the compounds capable of being reduced by Ca are formulated and mixed with the material formulation forming the aforesaid $R_1$-$R_2$-Fe-B and $R_1$-$R_2$-Fe-Co-B as the materials to be added. The alloys with the componental elements may include borides of V, Ti, Zr, Hf, Ta, Nb, Al, W, etc.

Use of the alloy powders of the present invention is very effective from the economical standpoint, since it is possible to simplify the steps for producing magnets and, hence, to provide the $R_1$-$R_2$-Fe-B or $R_1$-$R_2$-Fe-Co-B base rare earth magnets at lower costs.

When the starting materials, e.g., the mixed powders of the rare earth oxides with the Fe powder (or further the Co. powder), or metal powders such as the Fe-B powder are subjected to reduction and diffusion reactions by using of metallic Ca, the rare earth oxides are reduced by Ca to rare earth metals, now in a molten state, at a temperature at which the reduction reaction takes place. As the reducing agent Ca hydride may be used. Immediately thereupon, the molten rare earth metals are so easily and homogeneously alloyed with the Fe, Co or Fe-B powders, whereby the $R_1$-$R_2$-Fe-B or $R_1$-$R_2$-Fe-Co-B base alloy powders are recovered from the rare earth oxides in a high yield. It is thus possible to make effective use of the $R_1$ and $R_2$ rare earth oxide materials. The reduction technique hereinabove mentioned is referred to as "direct reduction".

The incorporation of B (boron) in the raw material powders is effective in lowering the reduction and diffusion reaction temperatures upon forming the $R_1$-$R_2$-Fe-B or $R_1$-$R_2$-Fe-Co-B alloy powders, so that the reduction and diffusion reactions of those alloy powders are facilitated.

It has been found that in order to mass-produce from cheap rare earth oxides the raw alloy powders for the $R_1$-$R_2$-Fe-B or $R_1$-$R_2$-Fe-Co-B magnets on an industrial scale, it is most effective to produce cheap alloy powders with Fe and B, and it is possible to use the RFeB alloy powders as such for the production of magnets. Based on these findings, the $R_1$-$R_2$-Fe-B and $R_1$-$R_2$-Fe-Co-B alloy powders within a specific composition range and a process for producing the same have been invented.

BRIEF DESCRIPTION OF THE DRAWINGS

FIG. 1 is a graphical view showing the relationship between the amount of Co added and the Curie temperature Tc in the $R_1$-$R_2$-Fe-Co-B base permanent magnet of the present invention.

PREFERRED EMBODIMENTS OF THE INVENTION

In the following disclosure, "%" means "atomic %", unless otherwise stated.

The rare earth-containing alloy powders according to the present invnetion are produced by the following steps.

At least one light rare earth ($R_2$) oxide such as Nd oxide ($Nd_2O_3$) or Pr oxide ($Pr_6O_{11}$), at least one heavy rare earth ($R_1$) oxide such as Tb oxide ($Tb_4O_7$) or Dy oxide ($Dy_2O_3$),-an iron (Fe) powder, at least one powder selected from the group consisting of pure boron, ferroboron (Fe-B) and boron oxide ($E_2O_3$) powders, and if required, a cobalt (Co) powder (wherein $R_1$ is at least one heavy rare earth element selected from the group consisting of Gd, Tb, Dy, Ho, Er, Tm and Yb, at least 80% of $R_2$ consists of Nd and/or Pr, the balance in $R_2$ being at least one element selected from the group consisting of rare earth elements including Y and except for $R_1$, and $R=R_1+R_2$ (by atomic %) are formulated into a given composition with (powders of) metals, oxides, alloys or other compounds, if required. In this manner, the mixed raw powders are obtained. Furthermore, the raw powders are added weith metallic Ca and/or Ca hydride as a reducing agent for the rare earth oxides and a $CaCl_2$ powder which serves to promote disintegration of the reaction product after reduction. The required amount of Ca is 1.2 to 3.5 times (by atomic ratio) of the stoichiometric amount necessitated for the reduction of oxygen contained in the mixed raw powders, and the amount of $CaCl_2$ is 1 to 15% (by weight) of the raw rare earth oxides.

The foregoing mixed powders comprising the rare earth oxide powder, Fe powder and ferroboron powder and, optionally, Co powder as well as the reducing agent Ca are subjected to reduction and diffusion treatments at a temperature ranging from 950° to 1200° C. (preferably 950° to 1100° C.) for approximately 1 to 5 hours in an inert gas atmosphere such as an argon gas atmosphere, and are cooled down to room temperature to obtain a reduction reaction product. A reaction vessel should be used which does not react or has a very low reactivity with rare earth elements, e.g., stainless steel. It is effective to coat the inside wall of the vessel with a lining such as MgO and/or CaO. The reaction product is crushed to a particle size of, e.g., 8 mesh (2.4 mm) or less, and is put into water, in which calcium oxide (CaO), CaO—$2CaCl_2$ and excessive calcium contained in the reaction product are converted into calcium hydroxide ($Ca(OH)_2$) and the like, so that the reaction product disintegrates, yielding a slurry mixed with water. The obtained slurry is sufficiently treated with water for the removal of excessive Ca to obtain the rare earth-containing alloy powders having a particle size of about 10 to about 500 microns. At a particle size below 10 microns, the oxygen amount in the resultant alloy increases leading to deterioration in the magnetic properties. Above 500 microns there is a case where insufficient diffusion reaction occurs at the reducing procedure resulting in occurrence of an -Fe phase in the resultant magnet thereby lowering the coercivity and deteriorating the loop squareness of the demagnetization curve.

It is preferred that the alloy powders of the present invention have a crystal grain size of 20 to 300 microns in view of workability in the step of the subsequent step of preparing magnets, and magnet properties.

When the reduction reaction product is put into water in a state where it is not made to a particle size not exceeding 8 mesh (2.4 mm) without crushing the aforesaid disintegration reaction is so delayed that it is unsuitable for industrial production. In addition, the heat of disintegration reaction is accumulated in the reduction product which is in turn brought to higher temperatures, so that the amount of oxygen contained therein exceeds 10,000 ppm. At such an oxygen content, difficulty will be involved in the later step of making magnets. At a particle size of less than 35 mesh (0.5 mm), so vigorous in the reaction in water that burning takes place. Water used in the present invention is preferably ion-exchanged water or distilled water in view of the yield of magnets in the magnet-making step to be described later and the magnet properties thereof, since there is then a decrease in the amount of oxygen contained in the alloy powders.

The rare earth-containing alloy powders obtained in this manner has a major phase (i.e., at least 80 vol % of the entire alloy phase) of the Fe-B-R (or Fe-Co-B-R) tetragonal structure, an oxygen content not exceeding 10,000 ppm, a carbon content not exceeding 1000 ppm and a calcium content not exceeding 2000 ppm.

Upon preparing the $R_1$-$R_2$-Fe-B or $R_1$-$R_2$-Fe-Co-B alloy powders, the alloy powders of the present invention can be finely pulverized as such, and be immediately made into permanent magnets by means of the powder metallurgical technique involving compacting—sintering (normal sintering or press-sintering)—aging. The finely pulverizing can be effected by using an Atriter, ball mill, jet mill or the like preferably to a particle size of 1–20 μm, more preferably 2–10 μm. It is to be noted that, in order to produce anisotropic magnets, the particles can be oriented and formed in a magnetic field. If the rare earth alloy powders of the present invention is used, it is possible to omit some steps of alloy melting—casting—coarse pulverization from the entire steps for preparing permanent magnets using as the raw bulk or lump materials of rare earth metal, iron and boron. There is also an advantage that the price of magnet products can be cut down due to the fact that cheap rare earth oxides can be used as the starting material. In addition, the present invention is economically advantageous in view of the fact that practical permanent magnet materials can easily be obtained on a mass-production scale.

The oxygen contained in the alloy powders of the present invention combines with the rare earth elements, which are most apt to oxidation, to form rare earth oxides. For that reason, an oxygen content exceeding 10,000 pm is not preferred, since the oxygen then remains in the permanent magnets in the form of oxides of R and Fe, so that the magnet properties drop, in particular the coercive force drops below 10 kOe and Br drops, too. Oxygen is preferably 6000 ppm or less, more preferably 4000 ppm or less.

In an amount of carbon exceeding 1000 ppm, the carbon remains in the permanent magnets in the form of carbides ($R_3C$, $R_2C_3$, $RC_2$, etc.), resulting in a considerable lowering of the coercive force below 10 kOe, and accompanied by a deterioration in the loop squareness of the demagnetization curve. Not exceeding 600 ppm carbon is preferred.

When the calcium content exceeds 2000 ppm, a large amount of strongly reducing Ca vapor is generated in the intermediate sintering step of the subsequent steps for making magnets from the alloy powders of the present invention. The Ca vapor contaminates the heat-treatment furnace used to a considerable extent and, in some cases, gives serious damage to the wall thereof, such that it becomes impossible to effect the industrially stable production of magnets. In addition, if the amount of Ca contained in the alloy powders formed by reduction is so large that a large amount of Ca vapor is generated at the time of heat treatment involved in the subsequent steps for making magnets to give damage to the heat treatment furnace used. This also leads to a large amount of Ca remaining in the resulting magnets, entailing deteriorations in the magnet properties thereof as a result. A calcium content of 1000 ppm or less is preferred.

Based on the similar reason Ca as the reducing agent should not exceed 3.5 times of the stoichiometric amount. On the other hand, where the amount of Ca is below 1.2 times of the stoichiometric amount, the reduction and difusion reactions are so incomplete that a large amount of unreduced matters remains resulting in that the rare earth alloy powders of the present invention cannot be obtained, or a bad yield will result. The Ca amount of 1.5–2.5 times is preferred, and most preferred is 1.6–2.0 times of the stoichiometric amount.

Where the amount of $CaCl_2$ exceeds 15% by weight of the rare earth oxides, the amount of $Cl^-$ (chlorine ions) increases considerably in water with which the reduction and diffusion reaction product is treated, and reacts with the resulting rare earth alloy powders. The resultant powders contain 10,000 ppm or higher of oxygen, and so cannot be used as the starting material for $R_1$-$R_2$-Fe-B or $R_1$-$R_2$-Fe-Co-B magnets. In the event that $CaCl_2$ is used in an amount below 1% by weight, it gives rise to difficulty in disintegration of the reduction and diffusion reaction product, when put into water, so that it is impossible to treat that powder with water. The amount of $CaCl_2$ is in a range of preferably 2 to 10% by weight, more preferably 3 to 6% by weight.

The range of components rare earth elements (R) and boron (B) of the rare earth alloy powders according to the present invention is:

R: 12.5 to 20 at % wherein $R_1$ is 0.05 to 5 at %, and
B: 4 to 20 at %.

The reason is that R (standing for at least one element selected from the group consisting of rare earth elements including Y) is an essential element for the novel $R_1$-$R_2$-Fe-B and $R_1$-$R_2$-Fe-Co-B base permanent magnets, which in an amount below 12.5 at %, causes precipitation of Fe from the present base alloy, gives rise to a sharp drop of the coercive force and, in an amount exceeding 20 at %, allows the coercive force to assume a value of 10 kOe or higher, but causes the residual magnetic flux density (Br) to decrease to a value which is smaller that required to obtain (BH)max of at least 20 MGOe.

The amount of $R_1$ (standing for at least one heavy rare earth element selected from the group consisting of Gd, Tb, Dy, Ho, Er, Tm and Yb) constitutes a part of the aforesaid R. In an amount of barely 0.05 at %, $R_1$ to be substituted serves to increase Hc and improve the loop rectangularity of demagnetization curves, leading to an incerease in (BH)max. Therefore, the lower limit of $R_1$ is 0.05 at %, taking into account the effects upon increases in both iHc and (BH)max. As the amount of $R_1$ increases, iHc increases, and (BH)max reaches a peak at 0.4 at % and decreases only gradually. However, for instance, even by 3 at %—$R_1$ substitution gives (BH)max of 30 MGOe or higher.

Higher iHc i.e., a larger amount of $R_1$ is more advantageous in applications wherein stability is particularly demanded. However, the elements constituting $R_1$ are only slightly found in rare earth ores, and are relatively expensive. Hence, the upper limit of $R_1$ is 5 at %. Particularly preferred $R_1$ is Dy and Tb, while Tm and Yb would be difficult in procurement. The $R_2$ element constituting the balance in the entire R is a main constitutional one for the permanent magnets according to the present invention, and 80 to 100% of $R_2$ consists of Nd and/or Pr, the balance (20 to 0%) in $R_2$ being at least one element selected from the group consisting of rare earth elements including Y except for $R_1$. In a range departing from the aforesaid range, it is impossible to obtain such magnet properties as expressed in terms of (BH)max of 20 MGOe or higher and iHc of 10 kOe or higher. It is desired that the amount of Sm and La to be used as $R_2$ be reduced as much as possible.

When the amount of B is below 4 at %, iHc drops to 10 kOe or lower. As the amount of B increases, the iHc increases as is the case with R, but Br decreases. In order to obtain (BH)max of 20 MGOe or higher, the amount of B should be 20 at % or lower. Hence, the amount of B is in a range of 4 at % to 20 at %.

The disclosure concerning R, $R_1$, $R_2$ and B is valid for all the aspects of the present invention.

As mentioned in the foregoing, the substitution of Co for a part of Fe has an effect upon increase in the Curie temperature Tc of the FeBR base permanent magnets (FIG. 1). As the amount of Co increases, the Curie temperature increases continuously. Since Co is effective and produces a significant effect in a slight amount, therefore, the presence at least 0.1 at % Co is preferred. It is to be noted, however, that any difficulty is not experienced in the production of the alloy powders, even when the amount of Co is below that lower limit. When the amount of Co exceeds 35 at %, the saturated magnetization and coercive force of the permanent magnets decrease. Co in an amount of 5 at % or more assures that the coefficient of temperature dependence of Br (25°–100° C.) is 0.1%/°C. or smaller. Furthermore, 25 at % or lower of Co contributes to an increase in the Curie temperature without causing any substantial deterioration of other properties, and about 20 at % (17–23 at %) of Co serves to increase iHc at the same time. A Co amount of about 5 to about 6 at % is most preferred.

Fe is an element inevitable for the novel $R_1$-$R_2$-Fe-B base permanent magnets, which, in an amount of below 60 at %, causes a lowering of residual magnetic flux density (Br) and, in an amount exceeding 83.5 at %, does not give any high coercive force. Hence, the amount of Fe is limited to 60 at %–83.5 at % in the 1st and 2nd aspects of the present invention.

It is noted that Fe shows a similar function in the $R_1$-$R_2$-Fe-Co-B base permanent magnets. However, the amount of Fe is limited to 45–82 at % (preferably up to 80 at %) and 40–82 at % (preferably 45 at % or more) in the 3rd and 4th aspects of the present invention, respectively. 60 at % or more of the sum of Fe and Co is preferred, and 60 at % or more Fe is most preferred.

In general, the incorporation of at least one element selected from the group consisting of the following additional elements M in place of a part of Fe of the aforesaid FeBR permanet magnet alloys makes it possible to increase the coercive force thereof. The additional elements M are in amounts not exceeding the values specified below:

5.0 at % Al, 3.0 at % Ti, 6.0 at % Ni,
5.5 at % V, 4.5 at % Cr, 5.0 at % Mn,
5.0 at % Bi, 9.0 at % Nb, 7.0 at % Ta,
5.2 at % Mo, 5.0 at % W, 1.0 at % Sb,
3.5 at % Ge, 1.5 at % Sn, 3.3 at % Zr,
3.3 at % Hf, and 5.0 at % Si.

These additional elements M may be added to the starting mixed powders in the form of metal powders, oxides, alloy powders or mixed oxides with the alloy-forming elements, or compounds capable of being reduced by Ca.

The aforesaid additional elements M have an effect upon the increase in iHc and improvement in the loop rectangularity of demagnetization curves. However, as the amount of M increases, Br decreases. To obtain (BH)max of 20 MGOe or higher Br should be at least 9 kG. For that reason, the upper limit of embodiment M is fixed at the aforesaid value except for the case with Bi, Ni and Mn. Bi is limited based on its high vapor pressure, and Ni and Mn are limited in view of iHc drop. When two or more additional elements M are included, the upper limit of the sum of M is not more than the maximum atomic percentage among those values specified above of said elements M actually added. For instance, when Ti, Ni and Nb are included, the upper limit of the sum thereof does not exceed 9% of Nb. Among others, preference is given to V, Nb, Ta, Mo, W, Cr and Al. The amount of the additional elements to be included is preferably smaller, and is effectively 3 at % or lower, in general. Referring to Al, it is included in an amount of 0.1 to 3 at %, particularly 0.2 to 2 at %. Si raises the Curie temperature.

Referring to the crystal phase of the rare earth-containing alloy powder according to the present invention, that its major phase (i.e., at least 80 vol %, or 90 vol %, 95 vol % or higher of the entire alloy) of the tetragonal structure is essential to obtain fine and uniform alloy powder which can exhibit high magnetic properties as magnets. This magnetic phase is constituted by an FeBR or FeCoBR tetragonal type crystal with the grain boundaries being surrounded by a nonmagnetic phase. The nonmagnetic phase is mainly constituted by an R-rich phase (R metal). In the case where the amount of B is relatively large, there is also partly present a B-rich phase. The presence of the nonmagnetic grain boundary region is considered to contribute to high properties, particularly to provide a high performance nucleation type magnet by sintering, and presents one important structural feature of the alloy according to the present invention. The nonmagnetic phase is effective even in only a slight amount, and, for instance, at least 1 vol % is sufficient. Turning to the lattice parameters of the tetragonal crystal, the a axis is about 8.8 Å, while the c axis is about 12.2 Å, and the central composition is considered to be $R_2Fe_{14}B$ or $R_2(Fe,Co)_{14}B$. The inventive alloy powders have generally the crystalline nature, i.e., typically with a crystal grain size of the crystals constituting the powder particle amounting to at least about 1 μm as far as the powder particle is larger than this size. The amount of the tetragonal structure phase can be measured by means of the intensity of the X-ray diffractometric chart or an X-ray microanalyser. Further, the sintered permanent magnet produced by using the inventive alloy powder is crystalline, wherein the tetragonal RFeB or R(Fe,Co)B crystal has preferably an average crystal grain size of 1–40 microns (more preferably 3–20 microns) for providing excellent permanent magnet characteristics.

According to the present invention as explained in detail, the alloy powders having a similar composition for producing the $R_1$-$R_2$-Fe-B or $R_1$-$R_2$-Fe-Co-B base magnets can be obtained at low costs, using as the starting materials rare earth oxides (and further boron oxide etc.). By using those alloy powders, it is possible to obtain the $R_1$-$R_2$-Fe-B or $R_1$-$R_2$-Fe-Co-B base permanent magnets having excellent properties and to omit the steps of preparing alloy powders of the specific composition, which comprises isolation and purification of rare earth metals—alloy making by melting—cooling (usually, casting)—pulverization, from the process for producing magnets, whereby that process can be simplified. Such simplification of the magnet production process is very useful in that any contamination of unpreferred components or impurities (oxygen, etc.) into the products is avoided. In particular, the prevention of oxygen, etc. from entering the products in the steps from melting through pulverization requires complicated process control and is carried out with difficulty, and offers one cause for a rise in the production cost.

Furthermore, it is not necessarily required to separate the rare earth oxides to be used into the individual oxides of rare earth. By using as the starting material a mixture of rare earth oxides, which has a composition approximate or corresponding to the target composition, or to which an additional amount of rare earth oxides is added to make up for a deficiency, it is possible to simplify the step per se for the separation of rare earth oxides and cut down the cost thereof.

In addition, the alloys of the present invention is very effective in that they are directly obtained as the alloys having a major phase of a RFeB or R(Fe,Co)B tetragonal magnetic phase inevitable for magnetic properties by the direct reduction technique, and are very advantageous in that they are obtained directly in the powdery form.

The alloy powders according to the present invention may contain, in addition to R, B, and Fe or (Fe+Co), impurities which are inevitably entrained from the industrial process of production. For instance, the alloy powders containing a total of 2 at % or lower of P, 2 at % or lower of S and 2 at % or lower of Cu still exhibit practical magnetic properties, which, however should be limited to the amounts corresponding to a Br of at least 9 kG since these impurities decrease Br, and should be as little as possible (e.g., less than 0.5 at % or less than 0.1 at %).

In the following, the embodiments of the present invention will be explained in further detail with reference to the examples. It is to be appreciated, however, that the invention is not limited to those examples.

EXAMPLES

Example 1

| | |
|---|---|
| $Nd_2O_3$ powder | 56.2 grams |
| $Dy_2O_3$ powder | 4.3 grams |
| Ferroboron powder | (19.5 wt % B—Fe alloy powder) 6.1 grams |
| Fe powder | 59.4 grams |
| Metallic Ca | 53.6 grams (2.5 times of the stoichiometrical amount) |
| $CaCl_2$ | 2.6 grams (4.3 wt % of the rare earth oxide raw materials) |

A total of 182.2 grams of the aforesaid starting powders were mixed together in a V-type mixer aiming at a resultant alloy having a target composition of 30.5% Nd-3.6% Dy-64.75% Fe-1.15% B (wt %) (14.1% Nd-1.5% Dy-77.3% Fe-7.1% B (at %)). (Note that, generally, the starting mixed powders are formulated by considering the yield of reduction reaction of the oxides.) The resulting mixture was then compacted or press-formed, and was charged in a vessel made of stainless steel. After the vessel had been placed in a muffle furnace, the temperature within the vessel through which an argon gas stream was fed was increased. The furnace was kept constant at 1150° C. for 3 hours, and was then cooled off to room temperature. The thus obtained reduction reaction product was coarsely pulverized to 8 mesh-through, and was thereafter poured in 10 liter ion-exchanged water, in which calcium oxide (CaO), $CaO—2CaCl_2$ and unreacted calcium residue contained in the reaction product were in turn converted into calcium hydroxide ($Ca(OH)_2$) to disintegrate (or collapse) the reaction product and put it into a slurried state. After one hour-stirring, the slurry was allowed to stand for 30 minutes in a stationary manner, then the formed calcium hydroxide suspension, was discharged followed by re-pouring of water. In this manner, the steps of stirring-stationary holding-removal of suspension were repeated plural times. The Nd-Dy-Fe-B base alloy powder separated and obtained in this manner was dried in vacuum to obtain 86 grams of the invented rare earth alloy powder of 20 to 300 microns suitable for magnet materials.

As a result of component analysis, the obtained alloy powder was found to have a desired composition of:

Nd: 30.4 wt %,
Dy: 3.5 wt %,
Fe: 63.6 wt %,
B: 1.2 wt %,
Ca: 800 ppm,
$O_2$: 4800 ppm, and
C: 750 ppm.

In consequence of a measurement of X-ray diffraction pattern, the obtained alloy powder was found to include as the major phase 95% or higher of an intermetallic compound of a RFeB tetragonal type structure in which a=8.77 Å, and c=12.19 Å.

The powder was finely pulverized to a mean particle size of 2.70 microns, and was compacted at a pressure of 1.5 t/cm$^3$ in a magnetic field of 10 kOe. Thereafter, the compact was sintered at 1120° C. for 2 hours in an Ar flow, and was aged at 600° C. for 1 hour to prepare a permanent magnet sample.

The sample was found to exhibit excellent magnet properties as expressed in term of Br=11.4 L kG, iHc=10.6 kOe and (BH)max=30.4 MGOe.

Example 2

| | |
|---|---|
| $Nd_2O_3$ powder | 44.9 grams, |
| $Dy_2O_3$ powder | 1.4 grams, |
| Ferroboron powder | (19.0 wt % B—Fe alloy powder) 6.1 grams, |
| Fe powder | 62.3 grams, |
| Metallic Ca | 41.3 grams (2.5 times of the stoichiometric amount), and |
| $CaCl_2$ | 2.3 grams (5.0 wt % of the rare earth oxide raw materials). |

With a view to obtaining an alloy having a target composition of 30.5% Nd-1.2% Dy-67.2% Fe-1.2% B (wt %) (13.8% Nd-0.5% Dy-78.5% Fe-7.2% B (by atomic %)), a total of 158.3 grams of the aforesaid starting powders were reduction-treated at 1050° C. for 3 hours otherwise in the same manner Example 1. In this manner, the invented rare rare earth alloy powder of 20 to 500 microns for magnet materials was obtained.

As a result of component analysis, the obtained powder was found to have a desired composition of:

Nd: 29.4 wt %,
Dy: 1.0 wt %,
Fe: 68.6 wt %,
B: 1.0 wt %,
Ca: 490 ppm,
$O_2$: 3300 ppm, and
C: 480 ppm.

In consequence of the measurement of X-ray diffraction pattern, the obtained alloy powder was found to include as the major phase 92% or higher of an intermetallic compound of a RFeB tetragonal type structure in which a=8.79 Å, and c=12.20 Å.

A permanent magnet sample was prepared according to Example 1, and was found to have excellent magnet properties as expressed in term of Br=12.4 kG, iHc=10.3 kOe, and (BH)max=37.2 MGOe.

Example 3

| | |
|---|---|
| $Nd_2O_3$ powder | 36.1 grams, |
| $La_2O_3$ powder | 3.7 grams, |
| $Dy_2O_3$ powder | 5.1 grams, |
| $Gd_2O_3$ powder | 3.0 grams, |
| Fe powder: | 57.5 grams, |
| Ferroboron powder | (19.0 wt % B—Fe alloy powder) 8.8 grams, |
| Metallic Ca | 54.8 grams (3.2 times of the stoichiometric amount), and |
| $CaCl_2$ | 4.8 grams (10 wt % of the rare earth oxide raw materials). |

With a view to obtaining an alloy of a target composition of 24.5% Nd-2.5% La-4.3% Dy-2.4% Gd-64.6% Fe-1.7% B (wt %) (11% Nd-1.2% La-1.7% Dy-1% Gd-75% Fe-10.1% B (by atomic %)), a total of 173.8 grams of the aforesaid starting powders were treated according to Example 1. In this manner, a 85 grams powder of 30 to 500 microns were obtained.

As a result of component analysis, the obtained powder was found to have a desired composition of:

Nd: 24.3 wt %,
La: 2.4 wt %,
Dy: 4.5 wt %,
Gd: 2.4 wt %,
Fe: 64.7 wt %,
B: 1.6 wt %,
Ca: 1000 ppm, $O_2$: 5500 ppm, and
C: 500 ppm.

In consequence of a measurement of X-ray diffraction pattern, the obtained powder was found to include as the major phase 89% or higher of an intermetallic compound of a RFeB tetragonal type structure in which a=8.80 Å, and c=12.24 Å.

The powder was finely pulverized to a mean particle size of 3.5 microns, and was compacted at a pressure of 1.5 t/cm$^2$ in a magnetic field of 10 kOe. Thereafter, the compact was sintered at 1100° C. for 2 hours in an argon flow, and was aged at 600° C. for 1 hour to prepare a permanent magnet sample, which was found to exhibit excellent magnet properties as expressed in term of Br=10.5 kG, iHc=13.5 kOe and (BH)max=24.7 MGOe.

Example 4

| | |
|---|---|
| $Nd_2O_3$ powder | 43.8 grams, |
| $Dy_2O_3$ powder | 4.5 grams, |
| Fe powder | 59.2 grams, |
| Fe—B powder | (19.0 wt % B—Fe alloy powder) 7.0 grams |
| $Al_2O_3$ (alumina) powder | 1.0 grams |
| Metallic Ca | 49.3 grams (2.8 times of the stoichiometric amount), and |
| $CaCl_2$ | 3.5 grams (7 wt % of the oxide materials). |

With a view to obtaining an alloy having a target composition of 29.7% Nd-3.7% Dy-64.8% Fe-1.3% B-0.4% Al (by weight %) (13.5% Nd-1.5% Dy-76.0% Fe-8% B-1.0% Al (by atomic %)), a total of 168.2 grams of the aforesaid starting powders were reduction-treated at 1080° C. for 3 hours otherwise according to Example 1. In this manner, an alloy powder of 30 to 500 microns was obtained in an amount of 83 grams.

As a result of a component analysis, the obtained powder was found to have a desired composition of:

Nd: 29.6 wt %,
Dy: 3.7 wt %,
Fe: 64.8 wt %,
B: 1.3 wt %,
Al: 0.5 wt %,
Ca: 850 ppm,
$O_2$: 3200 ppm, and
C: 780 ppm.

In consequence of the measurement of X-ray diffraction pattern, the obtained powder was found to include as the major phase 92% or higher of an intermetallic compound of a RFeB tetragonal type structure in which a=8.79 Å, and c=12.12 Å.

A permanent magnet sample was prepared according to Example 2, and was found to have excellent magnet properties as expressed in term of Br=11.3 kG, iHc=17.5 kOe, and (BH)max=29.8 MGOe.

Example 5

| | |
|---|---|
| $Nd_2O_3$ powder | 43.4 grams, |
| $Dy_2O_3$ powder | 4.4 grams, |
| Fe powder | 57.9 grams, |
| Ferroboron powder | (19.0 wt % B—Fe alloy powder) 6.9 grams, |
| Ferroniobium powder | (67.3 wt % Nd—Fe alloy powder) 2.1 grams, |
| Metallic Ca | 42.7 grams (2.5 times of the stoichiometric amount), and |
| $CaCl_2$ | 0.8 grams (12 wt % of the rare earth oxide raw materials). |

With a view to obtaining an alloy of the composition of 29.4% Nd-3.7% Dy-64.2% Fe-1.3% B-1.4% Nb (by weight %) (12.5% Nd-1.5% Dy-77.0% Fe-8% B-1% Nb (by atomic %)), a total of 158.2 grams of the starting powders were treated according to Example 3. In this manner, a 88 grams powder of 20 to 500 microns was obtained.

As a result of a component analysis, the obtained alloy powder was found to have a desired composition of:

Nd: 29.2 wt %,
Dy: 3.7 wt %,
Fe: 64.5 wt %,
B: 1.2 wt %,
Nb: 1.4 wt %,
Ca: 500 ppm,
$O_2$: 4300 ppm, and
C: 320 ppm.

In consequence of a measurement of X-ray diffraction pattern, the obtained powder was found to include as the major phase 95% or higher of an intermetallic compound of a RFeB tetragonal type structure in which a=8.80 Å, and c=12.23 Å.

A permanent magnet sample was prepared according to Example 3, and was found to have excellent magnet properties as expressed in term of Br=11.5 kG, iHc=14.5 kOe and (BH)max=30.5 MGOe.

Example 6

| | |
|---|---|
| $Nd_2O_3$ powder | 54.8 grams, |
| $Dy_2O_3$ powder | 5.6 grams, |
| Ferroboron powder | (19.5 wt % B—Fe alloy powder) 6.5 grams, |
| Fe powder | 42.6 grams, |
| Co powder | 18.6 grams, |
| Metallic Ca | 53.5 grams (2.5 times of the stoichiometric amount), and |
| $CaCl_2$ | 2.6 grams (4.3 wt % of the rare earth oxide raw materials). |

A total of 184.2 grams of the aforesaid starting powders were mixed together in a V-type mixer with a view to obtaining an alloy having a target composition of 30.0% Nd-3.6% Dy-47.7% Fe-17.5% Co-1.12% B (by weight %) (14.0% Nd-1.5% Dy-57.5% Fe-20% Co-7.0% B (by atomic %)). The resulting mixture was then compacted, and was charged in a vessel made of stainless steel. After the vessle had been placed in a muffle furnace, the temperature within the vessel through which an argon gas flow was fed increased. The furnace was kept constant at 1150° C. for 3 hours, and was then cooled off to room temperature. The thus obtained reduction reaction product was coarsely pulverized to 8 mesh-through, and was thereafter charged in 10 liter of ion-exchanged water, in which calcium oxide (CaO), $CaO\text{-}2CaCl_2$ and unreacted calcium residue contained in the reaction product were in turn converted into calcium hydroxide ($Ca(OH)_2$) to disintegrate the reaction product and put it into a slurried state. After one hour-stirring, the slurry was allowed to stand for 30 minutes in a stationary manner to discharge the formed calcium hydroxide suspension, followed by re-pouring of water. In this manner, the steps of stirring-stationary holding-removal of suspension were repeated plural times. The Nd-Dy-Fe-Co-B base alloy powder separated and obtained in this manner was dried in vacuum to obtain 84 grams of the invented rare earth alloy powder of 20 to 300 microns suitable for magnet materials.

As a result of a component analysis, the obtained alloy powder was found to have a desired composition of:

Nd: 30.2 wt %,
Dy: 3.3 wt %,
Fe: 48.2 wt %,
Co: 15.8 wt %,
B: 1.1 wt %,
Ca: 800 ppm,
$O_2$: 4100 ppm, and
C: 670 ppm.

In consequence of a measurement of X-ray diffraction pattern, the obtained alloy powder was found to include as the major phase 95% or higher of an intermetallic compound of a R(Fe,Co)B tetragonal type structure in which a=8.76 Å, and c=12.15 Å.

The powder was finely pulverized to a mean particle size of 2.50 microns, and was compacted at a pressure of 1.5 t/cm$^2$ in a magnetic field of 10 kOe. Thereafter, the compact was sintered at 1120° C. for 2 hours in an Ar flow, and was aged at 600° C. for 1 hour to prepare a permanent magnet sample.

The sample was found to exhibit excellent magnet properties as expressed in term of Br=11.5 kG, iHc=16.3 kOe and (BH)max=31.7 MGOe.

The coefficient of temperature of Br of this alloy magnet (between 25° C. and 100° C.; the same shall hereinafter apply.) was expressed in terms of $\alpha$=0.075%/°C.

Example 7

| | |
|---|---|
| $Nd_2O_3$ powder | 47.0 grams, |
| $Dy_2O_3$ powder | 1.6 grams, |
| Ferroboron powder | (19.0 wt % B—Fe alloy powder) 6.4 grams, |
| Fe powder | 61.2 grams, |
| Co powder | 4.4 grams, |
| Metallic Ca | 43.3 grams (2.5 times of the stoichiometric amount), and |
| $CaCl_2$ | 2.5 grams (5.0 wt % of the rare earth oxide raw materials). |

With a view to obtaining an alloy having a target composition of 30.4% Nd-1.2% Dy-62.7% Fe-4.5% Co-1.2% B (by weight %) (13.8% Nd-0.5% Dy-73.5% Fe-5% Co-7.2% B (by atomic %)), a total of 166.4 grams of the aforesaid starting powders were reduction-treated at 1070° C. for 3 hours according to Example 6. In this manner, the invented rare earth alloy powder of 20 to 500 microns for magnet materials was obtained in an amount of 79 grams.

As a result of component analysis, the obtained alloy powder was found to have a desired composition of:

Nd: 29.5 wt %,
Dy: 1.1 wt %,
Fe: 61.3 wt %,
Co: 4.1 wt %,
B: 1.1 wt %,
Ca: 490 ppm,
$O_2$: 3300 ppm, and
C: 480 ppm.

In consequence of a measurement of X-ray diffraction pattern, the obtained alloy powder was found to include as the major phase 93% or higher of an intermetallic compound of a R(Fe,Co)B tetragonal type structure in which a=8.79 Å, and c=12.18 Å.

A permanent magnet sample was prepared according to Example 6, and was found to have excellent magnet properties as expressed in term of Br=12.5 kG, iHc=12.1 kOe and (BH)max=37.4 MGOe.

The coefficient of temperature of Br of this alloy magnet was expressed in terms of $\alpha$=0.09%/°C.

Example 8

| | |
|---|---|
| $Nd_2O_3$ powder | 36.3 grams, |
| $CeO_2$ powder | 9.2 grams, |
| $Dy_2O_3$ powder | 3.1 grams, |
| $Gd_2O_3$ powder | 3.0 grams, |
| Fe powder | 49.9 grams, |
| Co powder | 8.0 grams, |
| Ferroboron powder | (19.0 wt % B—Fe alloy powder) 9.0 grams, |
| Metallic Ca | 68.5 grams (3.2 times of the stoichiometric amount), and |
| $CaCl_2$ | 5.2 grams (10 wt % of the rare earth oxide raw materials). |

With a view to obtaining an alloy having a composition of 24.4% Nd-4.3% Ce-2.5% Dy-2.4% Gd-55.7% Fe-9.0% Co-1.7% B (wt %) (11% Nd-2% Ce-1% Dy-1% Gd-75% Fe-10% B (at %)), a total of 192.2 grams of the aforesaid starting powders were treated according to Example 6. In this manner, the 87 grams of a powder of 30 to 500 microns were obtained.

As a result of a component analysis, the obtained alloy powder was found to have a desired composition of:

Nd: 24.1 wt %,
Ce: 4.0 wt %,
Dy: 2.3 wt %,
Gd: 2.2 wt %,
Fe: 55.9 wt %,
Co: 8.8 grams,
B: 1.6 wt %,
Ca: 1100 ppm,
$O_2$: 5500 ppm, and
C: 600 ppm.

In consequence of a measurement of X-ray diffraction pattern, the obtained powder was found to include as the major phase 87% or higher of an intermetallic compound of a R(Fe,Co)B tetragonal type structure in which a=8.80 Å, and c=12.24 Å.

The powder was finely pulverized to a mean particle size of 3.5 microns, and was compacted at a pressure of 1.5 t/cm$^2$ in a magnetic field of 10 kOe. Thereafter, the compact was sintered at 1100° C. for 2 hours in an Ar stream, and was aged at 600° C. for 1 hour to prepare a permanent magnet sample, which was found to have excellent magnet properties as expressed in term of Br=10.7 kG, iHc=10.4 kOe and (BH)max=25.2 MGOe.

The coefficient of temperature of Br of this alloy magnet was expressed in terms of $\alpha$=0.088%/°C.

Example 9

| | |
|---|---|
| $Nd_2O_3$ powder | 45.0 grams, |
| $Dy_2O_3$ powder | 5.0 grams, |
| Fe powder | 42.3 grams, |
| Co powder | 16.9 grams, |
| Fe—B powder | (19.0 wt % B—Fe alloy powder) 7.4 grams |
| $Al_2O_3$ (alumina) powder | 1.0 grams |

-continued

| | |
|---|---|
| Metallic Ca | 49.5 grams (2.8 times as of the stoichiometric amount), |
| $CaCl_2$ | 3.5 grams (7 wt % of the oxide materials). |

With a view to obtaining an alloy having the composition of 29.6% Nd-3.7% Dy-56.02% Fe-8.96% Co-1.3% B-0.4% Al (wt %) (13.5% Nd-1.5% Dy-66.0% Fe -10% Co-8% B-1.0% Al (at %)), a total of the aforesaid starting powders were reduction-treated according to Example 6 at 1080° C. for 3 hours. In this manner, an alloy powder of 30 to 500 microns was obtained in an amount of 88 grams.

As a result of a component analysis, the obtained alloy powder was found to have a desired composition of:

Nd: 29.6 wt %,
Dy: 3.7 wt %,
Fe: 55.9 wt %,
Co: 8.9 grams,
B: 1.2 wt %,
Al: 0.4 wt %,
Ca: 750 ppm,
$O_2$: 3100 ppm, and
C: 670 ppm.

In consequence of the measurement of X-ray diffraction pattern, the obtained alloy powder was found to include as the major phase 92% or higher of an intermetallic compound of a R(Fe,Co)B tetragonal type structure in which a=8.78 Å, and c=12.17 Å.

A permanent magnet sample was prepared according to Example 7, and was found to have excellent magnet properties as expressed in term of Br=11.5 kG, iHc=17.5 kOe and (BH)max=30.8 MGOe.

The coefficient of temperature of Br of this alloy magnet was expressed in terms of $\alpha$=0.085 %/°C.

EXAMPLE 10

| | |
|---|---|
| $Nd_2O_3$ powder | 44.1 grams, |
| $Dy_2O_3$ powder | 4.5 grams, |
| Fe powder | 49.9 grams, |
| Co powder | 8.0 grams, |
| Ferroboron powder | (19.0 wt % B—Fe alloy powder) 7.0 grams, |
| Ferroniobium powder | (67.3 wt % Nd—Fe alloy powder) 2.2 grams, |
| Metallic Ca | 43.0 grams (2.5 times of the stoichiometric amount), and |
| $CaCl_2$ | 5.8 grams (12 wt % of the rare earth oxide raw materials). |

With a view to obtaining an alloy of the composition of 27.4% Nd-3.7% Dy-52.7% Fe-13.5% Co-1.3% B-1.4% Nb (wt %) (12.5% Nd-1.5% Dy-62.0% Fe-15.0% Co-8% B-1% Nb (at %)), a total of 158.2 grams of the starting powders were treated according to Example 8. In this manner, 88 grams of a powder of 20 to 500 microns were obtained.

As a result of a component analysis, the obtained alloy powder was found to have a desired composition of:

Nd: 27.2 wt %,
Dy: 3.7 wt %,
Fe: 51.7 wt %,
Co: 13.9 wt %,
B: 1.2 wt %,
Nb: 1.4 wt %,
Ca: 700 ppm,
$O_2$: 4800 ppm, and
C: 560 ppm.

In consequence of the measurement of X-ray diffraction pattern, the obtained powder was found to include as the major phase 95% or higher of an intermetallic compound of a R(Fe,Co)B tetragonal type structure in which a=8.78 Å, and c=12.17 Å.

A permanent magnet sample was prepared according to Example 8, and was found to have excellent magnet properties as expressed in terms of Br=11.5 kG, iHc=14.5 kOe and (BH)max=30.5 MGOe.

A manner of producing permanent magnets by using alloy powders obtained by reducing rare earth oxides has been known in the art of Sm-Co magnets. However, the Sm-Co alloy powders require a high reduction temperature of 1150°–1300° C. whereby undesirable crystal grain growth is induced, difficulty in obtaining a powder with a uniform particle size upon distingration is caused, and the reaction vessel is seriously damaged through the reaction.

Ground or waste powders resulting from the machining procedure for the ultimate magnet products of the sintered alloy may be used as the starting material for the reducing reaction, too.

It should be understood that modifications may be made without departing from the gist of the present invention as disclosed in the entire disclosure and claimed hereinbelow.

What is claimed is:

1. A rare earth-iron-boron alloy powder which consists essentially of:

12.5 to 20 at % R wherein $R_1$ is 0.05 to 5 at %, 4 to 20 at % B, and 60 to 83.5 at % Fe, wherein $R_1$ is at least one heavy rare earth element selected from the group consisting of Gd, Tb, Dy, Ho, Er, Tm and Yb, 80 to 100 at % of $R_2$ consists of Nd and/or Pr, the balance in the $R_2$ being at least one element selected from the group consisting of rare earth elements including Y and except for $R_1$, and $R=R_1+R_2$ by atomic %, wherein a major phase of at least 80 vol % of the entire alloy consists of a tetragonal structure, and wherein oxygen does not exceed 10,000 ppm, carbon does not exceed 1000 ppm and calcium does not exceed 2000 ppm.

2. A rare earth-iron-cobalt-boron alloy powder which consists essentially of:

12.5 to 20 at % R wherein $R_1$ is 0.05 to 5 at %, 4 to 20 at % B, 45 to 82 at % Fe, and more than zero and up to 35 at % Co, wherein $R_1$ is at least one heavy rare earth element selected from the group consisting of Gd, Tb, Dy, Ho, Er, Tm and Yb, 80 to 100 wt % of $R_2$ consists of Nd and/or Pr, the balance in the $R_2$ being at least one element selected from the group consisting of rare earth elements including Y and except for $R_1$, and $R=R_1+R_2$ by atomic %, and wherein a major phase of at least 80 vol % of the entire alloy consists of a tetragonal structure, and wherein oxygen does not exceed 10,000 ppm, carbon does not exceed 1000 ppm and calcium does not exceed 2000 ppm.

3. An alloy powder as defined in claim 1 or 2, wherein at least one additional element M selected from the group consisting of the following elements in amounts not exceeding the values specified below is included in place of a part of said Fe:

5.0 at % Al, 3.0 at % Ti, 5.5 at % V, 6.0 at % Ni, 4.5 at % Cr, 5.0 at % Mn, 5.0 at % Bi, 9.0 at % Nb, 7.0 at % Ta, 5.2 at % Mo, 5.0 at % W, 1.0 at % Sb, 3.5 at % Ge, 1.5 at % Sn, 3.3 at % Zr, 3.3 at % Hf, and 5.0 at % Si.

4. An alloy powder as defined in claim 1, wherein the lattice parameters of said tetragonal crystal are a of about 8.8 Å and c of about 12.2 Å, and the central composition thereof is $R_2Fe_{14}B$.

5. An alloy powder as defined in claim 2, wherein the lattice parameters of said tetragonal crystal are a of about 8.8 Å and c of about 12.2 Å, and the central composition thereof is $R_2(Fe,Co)_{14}B$.

6. An alloy powder as defined in claim 1 or 2, which is capable of providing a magnetically anisotropic sintered magnet having a maximum energy product of at least 20 MGOe and a coercive force of at least 10 kOe.

7. An alloy powder as defined in claim 2, wherein Co is 0.1 to 25 at %.

8. An alloy powder as defined in claim 2, wherein Co is at least 5 at %.

9. An alloy powder as defined in claim 1, wherein Co is about 5–about 6 at %.

10. An alloy powder as defined in claim 1 or 2, wherein oxygen does not exceed 6000 ppm.

11. An alloy powder which is capable of providing a magnetically anisotropic sintered magnet having a maximum energy product of at least 20 MGOe and a coercive force of at least 10 KOe, which is the product of the process comprising the steps of:

providing a starting mixed powdery material by formulating at least one rare earth oxide of the rare earth elements specified below, an iron powder and at least one powder selected from the group consisting of a boron powder, a ferroboron powder and a boron oxide powder in such a manner that the resulting alloy has an alloy composition consisting essentially of:

12.5 to 20 at % R wherein $R_1$ is 0.05 to 5 at %, 4 to 20% B, and 60 to 83.5 at % Fe, wherein $R_1$ is at least one heavy rare earth element selected from the group consisting of Gd, Tb, Dy, Ho, Er, Tm and Yb, 80 to 100 at % of the $R_2$ consists of Nd and/or Pr, the balance in the $R_2$ being at least one element selected from the group consisting of rare earth elements including Y and except for $R_1$, and $R=R_1+R_2$ by atomic %;

mixing said starting mixed powdery material with metallic calcium and/or calcium hydride in an amount of 1.2 to 3.5 times by weight of the stoichiometric amount required for reduction with respect to the amount of oxygen contained in said starting mixed powdery material, and with calcium chloride in an amount of 1 to 15% by weight of said rare earth oxides;

reducing the resulting mixture at a temperature of 950° to 1200° C. in an inert atmosphere;

putting the resultant reaction product into water to provide a sluried state, and treating the resultant slurry with water by stirring the slurry and removing water to recover a resultant alloy powder having a major phase of a tetragonal structure amounting to at least 80 vol % of the entire alloy until the alloy powder reaches a calcium content not exceeding 2000 ppm.

12. An alloy powder which is capable of providing a magnetically anisotropic sintered magnet having a maximum energy product of at least 20 MGOe and a coercive force of at least 10 KOe, which is the product of the process comprising the steps of:

providing a starting mixed powdery material by formulating at least one rare earth oxide of the rare earth elements specified below, an iron powder, a cobalt powder and at least one powder selected from the group consisting of a boron powder, a ferroboron powder and a boron oxide powder in such a manner that the resulting alloy has a composition consisting essentially of:

12.5 to 20% R wherein $R_1$ is 0.05 to 5 at %, 4 to 20 at % B, more than zero and up to 35 at % Co, and 45 to 82 at % Fe, wherein $R_1$ is at least one heavy rare earth element selected from the group consisting of Gd, Tb, Dy, Ho, Er, Tm and Yb, 80 to 100% $R_2$ consists of Nd and/or Pr, the balance in the $R_2$ being at least one element selected from the group consisting of rare earth elements including Y and except for $R_1$, and $R=R_1+R_2$ by atomic %;

mixing said starting mixed powdery material with metallic calcium and/or Ca hydride in an amount of 1.2 to 3.5 times by weight ratio of the stoichiometric amount required for reduction with respect to the amount of oxygen contained in said starting mixed powdery material, and with calcium chloride in an amount of 1 to 15% by weight of said rare earth oxides, reducing the resulting mixture at a temperature of 950° to 1200° C. in an inert atmosphere, putting the resultant reaction product into water to provide a sluried state, and treating the resultant slurry with water by stirring the slurry and removing water to recover a resultant alloy powder having a major phase of a tetragonal structure amounting to at least 80 vol % of the entire alloy until the alloy powder reaches a calcium content not exceeding 2000 ppm.

13. An anisotropic sintered magnet which has a maximum energy product of at least 20 MGOe and a coercive force of at least 10 KOe which is obtained by compacting in a magnetic field and sintering the product of the process comprising the steps of:

providing a starting mixed powdery material by formulating at least one rare earth oxide of the rare earth elements specified below, an iron powder and at least one powder selected from the group consisting of a boron powder, a ferroboron powder and a boron oxide powder in such a manner that the resulting alloy has an alloy composition consisting essentially of:

12.5 to 20 at % R wherein $R_1$ is 0.05 to 5 at %, 4 to 20 at % B, and 60 to 83.5 at % Fe, wherein $R_1$ is at least one heavy rare earth element selected from the group consisting of Gd, Tb, Dy, Ho, Er, Tm and Yb, 80 to 100 at % of the $R_2$ consists of Nd and/or Pr, the balance in the $R_2$ being at least one element selected from the group consisting of rare earth elements including Y and except for $R_1$, and $R=R_1+R_2$ by atomic %;

mixing said starting mixed powdery material with metallic calcium and/or calcium hydride in an amount of 1.2 to 3.5 times by weight of the stoichiometric amount required for reduction with respect to the amount of oxygen contained in said starting mixed powdery material, and with calcium chloride in an amount of 1 to 15% by weight of said rare earth oxides;

reducing the resulting mixture at a temperature of 950° to 1200° C. in an inert atmosphere;

putting the resultant reaction product into water to provide a sluried state, and treating the resultant slurry with water by stirring the slurry and removing water to recover a resultant alloy powder having a major phase of a tetragonal structure amounting to at least 80 vol % of the entire alloy until the alloy powder reaches a calcium content not exceeding 2000 ppm.

14. An anisotropic sintered magnet which has a maximum energy product of at least 20 MGOe and a coercive force of at least 10 KOe which is obtained by compacting in a magnetic field and sintering the product of the process comprising the steps of:

providing a starting mixed powdery material by formulating at least one rare earth oxide of the rare earth elements specified below an iron powder, a cobalt powder and at least one powder selected from the group consisting of a boron powder, a ferroboron powder and a boron oxide powder in such a manner that the resulting alloy has a composition consisting essentially of:

12.5 to 20% R wherein $R_1$ is 0.05 to 5 at %, 4 to 20 at % B, more than zero and up to 35 at % Co, and 45 to 82 at % Fe, wherein $R_1$ is at least one heavy rare earth element selected from the group consisting of Gd, Tb, Dy, Ho, Er, Tm and Yb, 80 to 100% $R_2$ consists of Nd and/or Pr, the balance in the $R_2$ being at least one element selected from the group consisting of rare earth elements including Y and except for $R_1$, and $R=R_1+R_2$ by atomic %;

mixing said starting mixed powdery material with metallic calcium and/or Ca hydride in an amount of 1.2 to 3.5 times by weight ratio of the stoichiometric amount required for reduction with respect to the amount of oxygen contained in said starting mixed powdery material, and with calcium chloride in an amount of 1 to 15% by weight of said rare earth oxides, reducing the resulting mixture at a temperature of 950° to 1200° C. in an inert atmosphere, putting the resultant reaction product into water to provide a sluried state, and treating the resultant slurry with water by stirring the slurry and removing water to recover a resultant alloy powder having a major phase of a tetragonal structure amounting to at least 80 vol % of the entire alloy until the alloy powder reaches a calcium content not exceeding 2000 ppm.

* * * * *